US006357072B1

(12) United States Patent
Zinn

(10) Patent No.: US 6,357,072 B1
(45) Date of Patent: Mar. 19, 2002

(54) TOOTHBRUSH ASSEMBLY FOR BRUSHING AND RINSING

(76) Inventor: Kenneth S. Zinn, 7905 Washington Park Dr., Centerville, OH (US) 45459-3650

( * ) Notice: Subject to any disclaimer, the term of this patent is extended or adjusted under 35 U.S.C. 154(b) by 0 days.

(21) Appl. No.: 09/565,915

(22) Filed: May 5, 2000

(51) Int. Cl.[7] ..... A46B 17/08; B05B 17/08

(52) U.S. Cl. ..... 15/105; 15/167.1; 15/246; 239/24; 30/141; 30/324; D4/108; D4/113

(58) Field of Search ..... 15/105, 167.1, 15/246; 30/141, 324; 239/24, 25, 33; 132/308; D4/108, 113

(56) References Cited

U.S. PATENT DOCUMENTS

| | | | | | |
|---|---|---|---|---|---|
| 416,401 | A | * | 12/1889 | Cushman | 15/105 |
| 1,176,248 | A | * | 3/1916 | Rottner et al. | 30/324 X |
| 2,028,519 | A | * | 1/1936 | Peterkin et al. | 15/167.1 X |
| 2,145,306 | A | * | 1/1939 | Hunneman | 15/105 X |
| 2,543,025 | A | * | 2/1951 | Hunneman, Jr. | 15/105 X |
| 2,956,749 | A | * | 10/1960 | Perry | 15/105 X |
| 3,338,522 | A | * | 8/1967 | McGee | 239/24 |
| 3,361,355 | A | * | 1/1968 | Renee | 15/105 X |
| 3,504,852 | A | * | 4/1970 | Abbott | 15/105 X |
| 4,934,597 | A | | 6/1990 | Cruther | 239/27 |
| 4,949,709 | A | * | 8/1990 | Bojovich | 15/167.1 X |
| 5,338,124 | A | | 8/1994 | Spicer et al. | 401/280 |
| D391,399 | S | | 3/1998 | Mills | D4/108 |

FOREIGN PATENT DOCUMENTS

| | | | | |
|---|---|---|---|---|
| IT | 557891 | * | 2/1957 | 15/105 |

* cited by examiner

*Primary Examiner*—Mark Spisich
(74) *Attorney, Agent, or Firm*—R. William Graham

(57) ABSTRACT

A toothbrush assembly for brushing one's teeth and rinsing one's mouth includes a toothbrush having a longitudinal handle with a brush head at one end of the handle and a rinsing attachment including a sloped inner recessed surface area to produce a fountain-like effect when a stream of water contacts therewith.

5 Claims, 1 Drawing Sheet

TOOTHBRUSH ASSEMBLY FOR BRUSHING AND RINSING

BACKGROUND OF THE INVENTION

The present invention relates generally to dental hygiene and in particular to a toothbrush assembly having bristles for brushing teeth and a water fountain device for rinsing the teeth and mouth after brushing.

Proper brushing is essential for maintaining healthy teeth and gums. Rinsing the mouth after brushing is also necessary for good oral hygiene. A person, after brushing, typically reaches for a container such as a glass or cup, fills the container with water, and then uses the water in the container to rinse his/her mouth. This function is generally repeated several times since the container holds only a limited amount of water. Alternately, one cups his/her hand(s) under flowing water from a faucet and uses the continuous flow of water to rinse the mouth.

In U.S. Pat. No. 5,338,124 the Spicer et al., there is described a water squirt toothbrush which consists of a handle having a chamber containing a limited amount of water which upon activation of a water squirting mechanism, water is forced out of the chamber and into the bristles of the toothbrush to rinse the teeth of the user. The effectiveness of the device to thoroughly rinse the user's mouth is extremely limited by the amount of water contained in the chamber.

U.S. Pat. No. Dec. 391,399 to Mills illustrates a toothbrush kit containing a disposable toothbrush, a packet of toothpaste, and a disposable, foldable rinsing cup.

U.S. Pat. No. 4,934,597 to Crutcher discloses a plastic fountain attachment for a faucet. The distal end of the attachment has a flap which can be held against an opening in the attachment such that water flowing from the faucet through the attachment is diverted through an upwardly directed conduit providing a fountain outlet for drinking.

Various other conventional dental care devices which are available are unable to provide the novel improvements of the present invention.

SUMMARY OF THE INVENTION

In accordance with the present invention, it is a primary object to provide a toothbrush assembly which is simple and easy to use for brushing one's teeth and rinsing one's mouth after brushing.

It is another object of the present invention to provide a toothbrush assembly for brushing one's teeth and rinsing one's mouth after brushing wherein the rinsing is not restricted by a limited reservoir of water.

It is still another object of the present invention to provide a toothbrush assembly which is economical to manufacture.

It is yet another object of the present invention to provide a toothbrush assembly having separate brushing and rinsing components.

The present invention describes and illustrates a toothbrush assembly for brushing one's teeth and rinsing one's mouth after brushing. In accordance with the invention, the assembly includes a toothbrush and a rinsing attachment at the end of the toothbrush handle opposite the brush head. After brushing one's teeth, the toothbrush assembly with the rinsing attachment is placed under a flow of water from a faucet such that the flow of water is directed into a recessed surface area of the rinsing device where it provides a fountain of water which can be easily and conveniently used by the user to rinse his/her mouth.

DETAILED DESCRIPTION OF THE INVENTION

Figure 1:
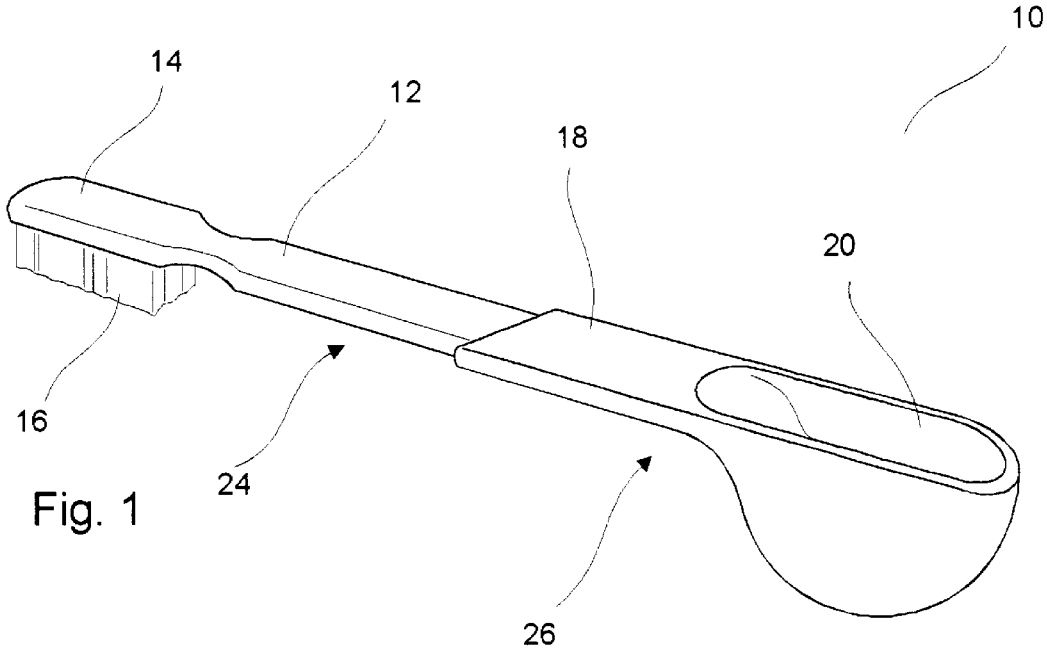
FIG. 1 is a perspective view of the toothbrush assembly of the present invention.
Figure 2:
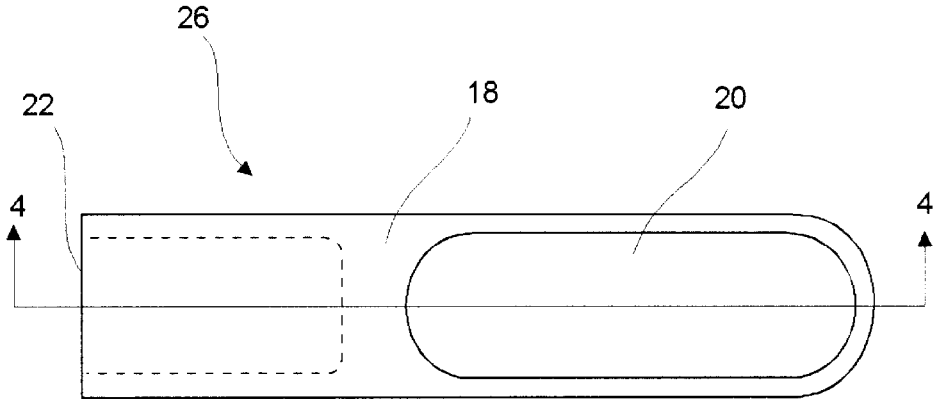
FIG. 2 is a top view of the rinsing attachment of the assembly.
Figure 3:
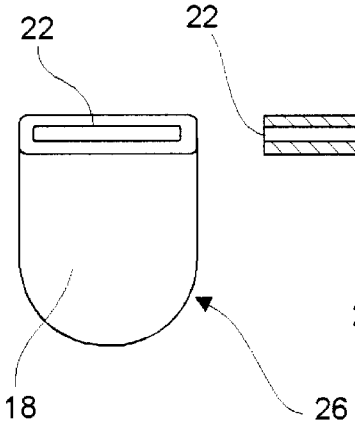
FIG. 3 is an end view of the rinsing attachment of the assembly.
Figure 4:
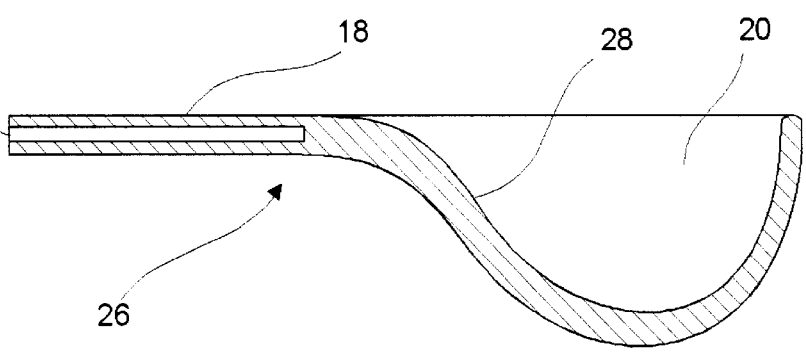
FIG. 4 is a sectional view of the rinsing attachment of the assembly taken along line 4 of FIG. 2.

Turning to the drawings in which similar reference numerals refer to similar elements throughout the various views, FIG. 1 illustrates a toothbrush assembly 10 which consists of a toothbrush 24 and a rinsing attachment 26. The toothbrush 24 has a first longitudinally extending handle 12 and a brush head 14 attached to one end of the first longitudinally extending handle 12. A plurality of bristles 16 extend outwardly from one face of the head 14. The rinsing attachment 26 consists of a second longitudinally extending handle 18. The male distal end of the first longitudinally extending handle 12 mates with the female opening 22 in the distal end of the second longitudinal extending handle 18 to secure the rinsing attachment 26 to the toothbrush 24. A toothbrush assembly wherein the toothbrush and the rinsing fountain are integrally formed as a single unit is within the concept of the present invention.

The rinsing attachment 26 may be is manufactured from any material compatible with oral hygiene. Typically, the material is a flexible polymeric material such as polyolefin, rubber, etc. The flexibility of the material used to manufacture the rinsing attachment allows a toothbrush handle to be easily inserted into the female opening in the handle of the rinsing attachment. In addition, the flexibility of the material also provides elasticity properties which secure the toothbrush handle 12 in the opening 22 and preferably accommodates a variety of handle sizes and shapes.

The recessed area 20 in the rinsing attachment 26 which provides the fountain of water for rinsing one's mouth is shaped much like a scoop where water from a faucet entering the back of the recessed area strikes a shallow slope surface 28, follows the inner surface of the recessed area 20 and exits the recessed area 20 along the back surface which exhibits a steep slope to provide a fountain effect. The slopes of the front 28 and back surfaces, respectively, of the recessed area 20 are not critical so long as the desired effect is accomplished.

In using the toothbrush assembly of the present invention, it is envisioned that a person carries out the normal function of brushing his/her teeth, and then simply places the toothbrush assembly under running water from a faucet or similar source such that the water strikes the recessed area 20 of the rinsing attachment 26 in a manner to provide a water fountain, and finally conveniently rinses his/her mouth using the continual jet of water gushing from the fountain.

While certain novel features of their invention have been shown and described herein, it will be understood that various changes, alterations, omissions and additions in the form and details of the invention illustrated and described may be made by those skilled in the art without departing from the spirit and scope of the appended claims.

What is claimed is:

1. A toothbrush assembly for brushing one's teeth and rinsing one's mouth comprising a toothbrush which includes a longitudinal handle having a brush head at one end of said handle and a rinsing attachment releasably connected to a distal end of said handle which includes a sloped inner recessed surface area to produce a fountain-like effect when a stream of water contacts therewith, wherein said rinsing attachment includes a handle portion being releasably secured to the distal end of said longitudinal toothbrush handle by way of a female fastener opening in an end of said handle portion opposite said recessed surface area for accepting and securing the distal end of said toothbrush handle.

2. The assembly of claim 1, wherein said sloped inner recessed surface area is generally cup shaped.

3. The assembly of claim 1 wherein said sloped inner recessed surface area has a first area exhibiting shallow sloping and an oppositely disposed second area exhibiting steep sloping, wherein a stream of water entering said rinsing attachment strikes said first area exhibiting shallow sloping and exits along said second area exhibiting steep sloping thereby causing said water to erupt in the form of a water fountain.

4. A rinsing attachment for use in conjunction with a toothbrush for brushing one's teeth and rinsing one's mouth, said attachment comprising a first end having a sloped inner recessed surface area to produce a fountain-like effect when a stream of water contacts therewith and a second end with means for securing said rinsing attachment to the toothbrush wherein said second end includes a female fastener opening to receive a male end of the toothbrush.

5. The attachment of claim 4, wherein said sloped inner recessed surface area has a first area exhibiting shallow sloping and an opposing second area exhibiting steep sloping, wherein a stream of water entering said rinsing attachment strikes said first area exhibiting shallow sloping and exits along said second area exhibiting steep sloping thereby causing said water to erupt in the form of a water fountain.

* * * * *